US006189224B1

(12) United States Patent
Theurer et al.

(10) Patent No.: US 6,189,224 B1
(45) Date of Patent: Feb. 20, 2001

(54) MACHINE AND METHOD FOR REHABILITATING A BALLAST BED

(75) Inventors: Josef Theurer; Bernhard Lichtberger, both of Vienna (AT)

(73) Assignee: Franz Plasser Bahnbaumaschinen Industriegesellschaft m.b.H, Vienna (AT)

( * ) Notice: Under 35 U.S.C. 154(b), the term of this patent shall be extended for 0 days.

(21) Appl. No.: 09/120,036

(22) Filed: Jul. 21, 1998

(30) Foreign Application Priority Data

Aug. 20, 1997 (AT) ..... A 1396/97

(51) Int. Cl.[7] ..... E01B 35/02
(52) U.S. Cl. ..... 33/338; 33/287
(58) Field of Search ..... 33/1 Q, 286, 287, 33/338, 613, 645, 651, 651.1

(56) References Cited

U.S. PATENT DOCUMENTS 3,750,299 * 8/1973 Plasser et al. ..... 33/287
4,490,038 * 12/1984 Theurer et al. ..... 33/338
5,174,038 * 12/1992 Neyens et al. ..... 33/338
5,301,548 * 4/1994 Theurer ..... 33/287
5,791,063 * 8/1998 Kesler et al. ..... 33/651
6,014,815 * 1/2000 Jager ..... 33/287

FOREIGN PATENT DOCUMENTS 2268529 2/1995 (GB) .
2268021 1/1996 (GB) .

* cited by examiner

*Primary Examiner*—Christopher W. Fulton
*Assistant Examiner*—Quyen Doan
(74) *Attorney, Agent, or Firm*—Horst M. Kasper

(57) ABSTRACT

A machine frame of a ballast bed rehabilitation machine is composed of two articulatedly coupled frame parts. A longitudinal inclination meter is mounted on the leading frame part, in the working direction, for detecting the inclination of the track. A laser reference system is provided for controlling the position of vertically adjustable track working units arranged on the trailing frame part, the laser reference system being formed by a laser transmitter, equipped for relative adjustment of a reference plane by means of an adjusting device, and laser receivers. A control device is designed for the time-delayed delivery, in dependence upon the distance travelled, of a longitudinal inclination value detected by the longitudinal inclination meter to the adjusting device of the laser transmitter. The reference plane, used to guide the working units, is adjusted in accordance with the detected longitudinal track inclination.

10 Claims, 2 Drawing Sheets

MACHINE AND METHOD FOR REHABILITATING A BALLAST BED

BACKGROUND OF THE INVENTION

1. Field of the Invention

The present invention relates to a mobile track working machine for rehabilitating a ballast bed supporting a track extending in a longitudinal direction, comprising a machine frame extending in the longitudinal direction and supported on the track by undercarriages for mobility in an operating direction. The machine frame is composed of a first frame part, leading in the operating direction, and a second frame part linked thereto. A longitudinal inclination meter is mounted on the first frame part for detecting an inclination of the track in the longitudinal direction. Working units are mounted on the second frame part, the working units being adjustable with respect to a vertical direction. A laser reference system is arranged on the machine frame for controlling the vertical position of the working units, the laser reference system being formed by a laser transmitter for establishing a reference plane and laser receivers for detecting said reference plane. An adjusting device is associated with the laser transmitter for relative adjustment of the position of the reference plane, and an odometer is mounted on the machine frame.

This invention also relates to a method for restoring a position of a track extending in a longitudinal direction, which position has been destroyed in the course of rehabilitating a ballast bed supporting the track.

2. Description of the Prior Art

A ballast cleaning machine formed by two frame parts which are articulatedly connected to one another is known from GB 2,268,021. A laser reference system serves for detecting the longitudinal inclination of the track in the region of the forward, first frame part in order to be able to control, in accordance with said measurement, the vertical position of working units located on the second frame part. To that end, a laser transmitter is provided which is permanently kept in a horizontal position. Arranged on the front undercarriage of the first frame part is a laser receiver which serves for detecting the longitudinal inclination of the first frame part with reference to the horizontal laser reference plane. The longitudinal inclination value computed via an algorithm is conveyed in a time-delayed manner to a further laser receiver located on a clearing chain on the second frame part in order to thereby be able to control the vertical position of the clearing chain.

Additionally known from GB 2,268,529 is a ballast cleaning machine in which respective longitudinal and transverse inclination meters are fastened to a first as well as to a second frame part. The longitudinal inclination of the track measured in the region of the first frame part is stored as a desired value and passed on in a time-delayed manner for controlling the vertical position of a clearing chain. To that end, the actual, existing inclination detected by the longitudinal inclination meter of the second frame part must be taken into account. For the purpose of controlling the vertical position, a cable potentiometer is provided which is arranged between the second frame part and the clearing chain. Since reproducing the position of the track is accomplished via the second frame part, inaccuracies caused by twisting or deflection of the frame cannot be precluded.

SUMMARY OF THE INVENTION

It is the primary object of this invention to improve a mobile track working machine of the first-described type in such a manner that it becomes possible to restore the original or actual position of the track relatively accurately and without difficulty during working operation of this machine.

In a mobile track working machine for rehabilitating a ballast bed supporting a track extending in a longitudinal direction, comprising a machine frame extending in the longitudinal direction and supported on the track by undercarriages for mobility in an operating direction, the machine frame being composed of a first frame part, leading in the operating direction, and a second frame part linked thereto, and also comprising a longitudinal inclination meter mounted on the first frame part for detecting an inclination of the track in the longitudinal direction, and also comprising working units mounted on the second frame part, the working units being adjustable with respect to a vertical direction, and further comprising a laser reference system arranged on the machine frame for controlling the vertical position of the working units, the laser reference system being formed by a laser transmitter for establishing a reference plane and laser receivers for detecting said reference plane, and also comprising an adjusting device associated with the laser transmitter for relative adjustment of the position of the reference plane, and further comprising an odometer mounted on the machine frame, the above and other objects are accomplished according to this invention by connecting a control device to the longitudinal inclination meter as well as to the odometer and the adjusting device, the control device being designed for conveying, in a time-delayed manner and in dependence upon the distance travelled by the machine as registered by the odometer, a longitudinal inclination value detected by the longitudinal inclination meter to the adjusting device for the purpose of adjusting the reference plane in accordance with the detected longitudinal inclination of the track.

With a reference system including a control device designed in such a way, it is possible with relatively small structural expense to very easily and simply detect the longitudinal inclination of the track existing before the destruction of the track position by the machine, and to reproduce said track inclination in the area of the working units. In this, it is of particular advantage that any deflection or twisting of the frame which might possibly occur is without any influence whatsoever on the measuring result.

According to another aspect of the present invention, there is provided a method for restoring a position of a track extending in a longitudinal direction, which position has been destroyed in the course of rehabilitating a ballast bed supporting the track, using a track working machine having a machine frame composed of a first and second frame part, the method comprising the steps of detecting an inclination of the track in the longitudinal direction with the aid of the first frame part, leading in an operating direction of the machine; registering and storing a corresponding longitudinal inclination value, defined by the said first frame part, as a desired inclination value; using said longitudinal inclination value in a time-delayed manner to correspondingly adjust the inclination of a reference plane, formed by a laser beam, as soon as the second frame part, in the course of working advance of the machine, reaches the local region of the detected longitudinal inclination of the track; and using the reference plane for controlling the vertical position of working units located on the second frame part.

This method according to the invention makes it possible to reproduce with relatively simple means the previously existing track position which got demolished by the operation of the working units. For this purpose, the longitudinal level of the track is continuously registered in front of the working units in the operating direction. With the aid of the laser reference system, a reference plane can be created in the region of the working units which is independent of the vertical position of the second frame part, the reference plane being inclined in accordance with the longitudinal inclination of the track as detected immediately before by a longitudinal inclination meter. Thus it is possible to restore the track position existing before operation of the machine quickly and easily while at the same time avoiding time-consuming re-tooling procedures.

BRIEF DESCRIPTION OF THE DRAWING

The above and other objects, advantages and features of the present invention will become more apparent from the following detailed description of a now preferred embodiment thereof, taken in conjunction with the accompanying, somewhat schematic drawing wherein.

DETAILED DESCRIPTION OF PREFERRED EMBODIMENT

Figure 1:
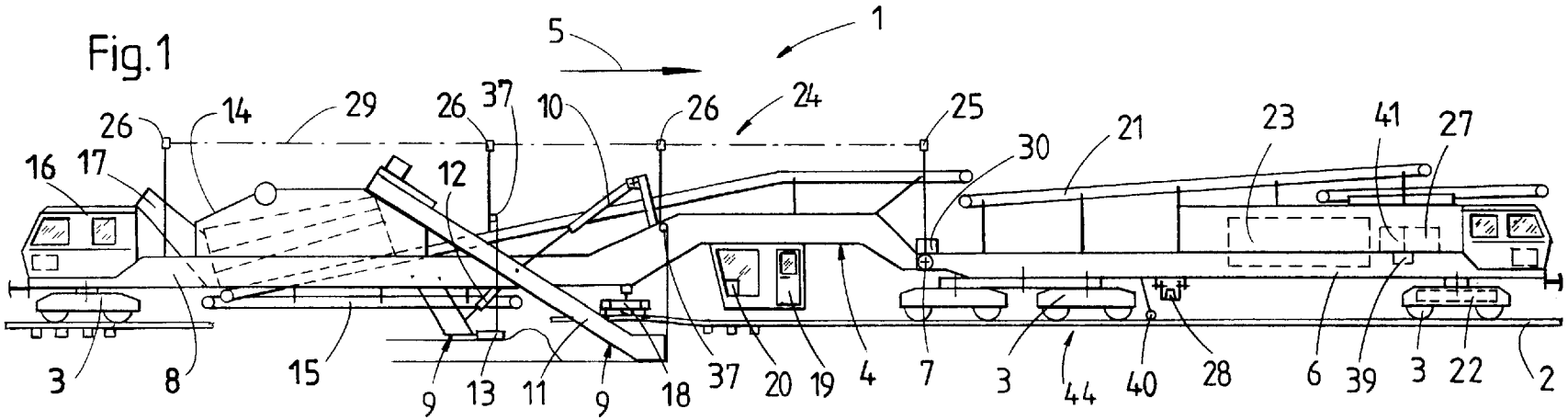
FIG. 1 is a side elevational view of a track working machine for cleaning ballast of a ballast bed of a track, incorporating the reference system and control device of this invention.

Referring now to the drawing and first to FIG. 1, there is shown a track working machine 1 for cleaning ballast of a ballast bed 44 supporting a track 2 extending in a longitudinal direction. The machine has a machine frame 4 which extends in the longitudinal direction and is supported on the track 2 by undercarriages 3 for mobility in an operating direction indicated by arrow 5. The machine frame 4 is composed of a first frame part 6, located in front with respect to the operating direction, and a rearward, second frame part 8 connected thereto via an articulation 7.

Located on the second frame part 8 are working units 9 constructed for treating the ballast bed 44, the working units having the shape of a clearing chain 11, vertically adjustable by a drive 10, as well as a grading chain 13 which is vertically adjustable by a drive 12 and immediately follows said clearing chain 11. A vibratable screening arrangement 14 is provided for cleaning the ballast taken up by the clearing chain 11. The cleaned ballast is discharged via a discharge conveyor belt 15 pivotable in a horizontal plane. Located between the screening arrangement 14 and a rear driver's and operator's cab 16 is a chute 17 through which new ballast may be fed to the discharge conveyor belt 15 as required. A vertically adjustable lifting device 18 is provided for lifting the track 2. Located immediately in front of the clearing chain 11 is an operator's cab 19 containing a central control console 20. The spoil accumulating in the course of the cleaning operation may be transported away to the forward machine end via a conveyor unit 21. A motor unit 23 is provided on the front frame part 6 for supplying energy to the various drives and to motive drives 22 of the machine 1.

A laser reference system 24 is arranged on the machine 1 for controlling the vertical position of the working units 9 and for checking the newly-created vertical position of the track 2 in the region of the rearmost undercarriage 3. The laser reference system 24 is essentially composed of a laser transmitter 25 positioned in the area of the articulation 7, laser receivers 26 located in the region of the working units 9 and the driver's and operator's cab 16, a control device 27, and a longitudinal inclination meter 28 fastened to the first frame part 6. The laser transmitter 25, creating a reference plane 29 by spreading a laser beam in a fan-like manner, is designed for tilting in the longitudinal direction with the aid of an adjusting device 30. A transverse inclination meter 39 is provided for detecting the inclination of the track in a direction extending transversely to the longitudinal direction.

Figure 2:
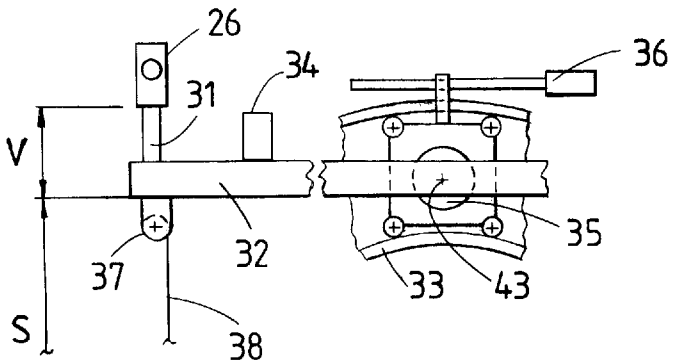
FIG. 2 is an enlarged, fragmentary view in the longitudinal direction, showing a laser receiver of the reference system.

As is evident in more detail now in FIG. 2, each laser receiver 26 is attached to an auxiliary frame 32 which, in turn, is mounted for transverse displacement on a guide 33. The latter is of circular shape, extends transversely to the longitudinal direction and is connected to the second frame part 8. Each laser receiver 26 is designed for vertical adjustment (adjustment path V) relative to the auxiliary frame 32 by means of a drive 31. The auxiliary frame 32, together with the laser receiver 26, is displaceable in the transverse direction on the said guide 33 by means of a spindle drive 36. During this transverse displacement, the auxiliary frame 32 is permanently kept in a horizontal position with the aid of a drive 35 by being rotated about an axis 43 extending in the longitudinal direction, the drive 35 being controlled by an inclinometer 34 mounted on the auxiliary frame 32. Each auxiliary frame 32 is connected at either end to a respective cable potentiometer 37, the cable 38 of which is releasably connected to the respective working unit 9 located thereunder. By means of the cable potentiometer 37, a vertical measuring value S is detected. Via the circular guide 33, the theoretical center point of which is positioned five meters lower, the laser receiver 26 is displaced in the transverse direction to compensate for the versines in track curves.

Figure 3:
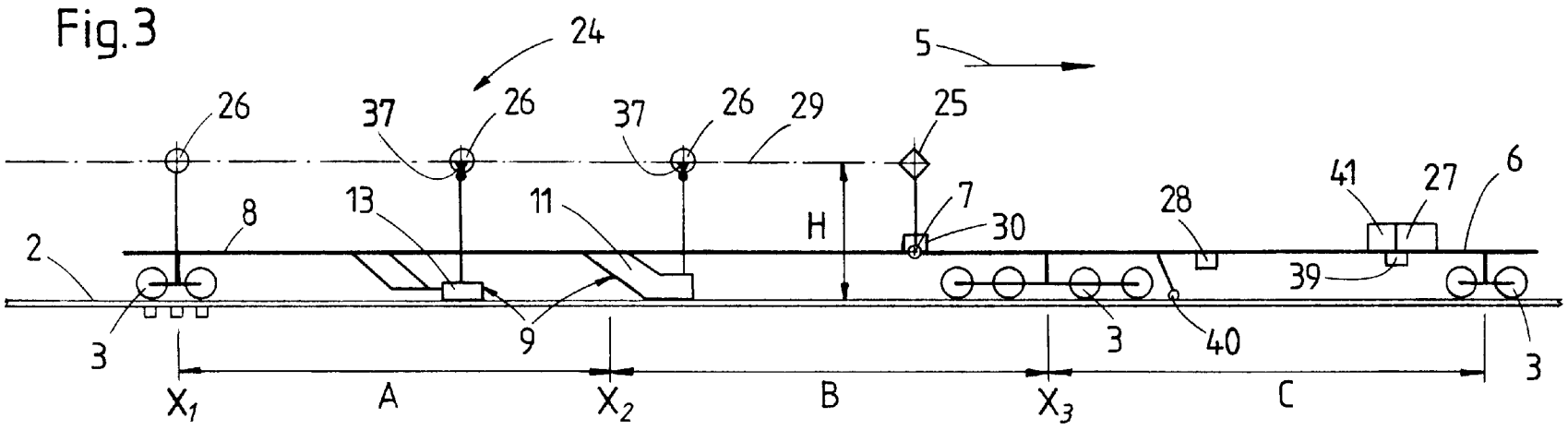
FIGS. 3 and 4 are schematic representations of the reference system of the machine of FIG. 1.
Figure 4:
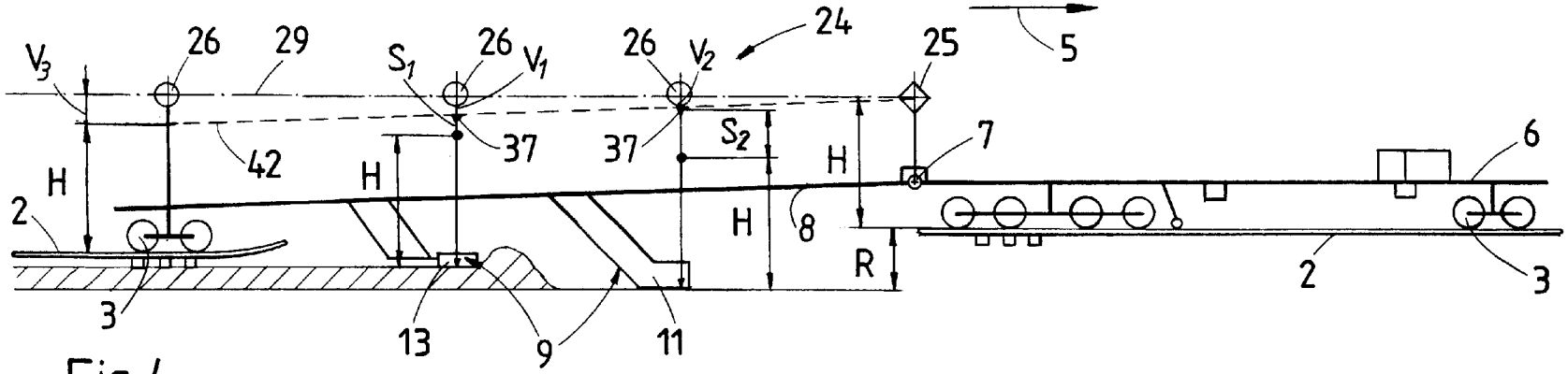

Referring now also to FIGS. 3 and 4 of the drawing, the operating principle of the laser reference system 24 will be explained. The reference plane 29 is adjusted with regard to the longitudinal direction to extend parallel to the inclination of the old track 2 which is registered in the region of the first frame part 6 (that is the existing position of the track 2 present in the region of the first frame part 6 before the working operation of the working units 9). At the same time, the reference plane 29 is also adjusted to extend level in the transverse direction and at a constant vertical distance from the track axis, as soon as the second frame part 8 reaches the corresponding section of the old track 2. With respect to this artificial reference plane 29, measurements are taken in three places in the region of the second frame part 8, namely in the region of the clearing chain 11 (giving the clearing depth), in the region of the grading chain 13 (giving the amount of lowering of the track 2), and in the region of the rear undercarriage 3 where the newly created position of the track 2 (i.e. the re-created original position of the track) is checked.

The transverse position of the track 2 is measured with the aid of the transverse inclination meter 39. By means of the longitudinal inclination meter 28, the longitudinal inclination of the first frame part 6 is measured (at track location $X_3$ in the situation shown in FIG. 3), said inclination being defined by the points of support of the two undercarriages 3 on the track 2. With this longitudinal inclination of the first frame part 6, the corresponding longitudinal inclination of track section C (=position of the old track) associated with the first frame part 6 can indirectly also be detected. The distance travelled by the machine 1 during working operations is detected an odometer 40. For each meter travelled, a longitudinal inclination value is written into a shift register 41 of the control device 27. Since the distance between the bogie pivots of the first frame part 6 is 12 meters and that of the second frame part 8 is 24 meters, the longitudinal inclination value measured at track location $X_1$ (for track section A), after a 24-meter advance of the machine 1, is found in 25th place in the shift register 41. This longitudinal inclination value is added to the 13th longitudinal inclination value in the shift register 41 (measured at track location $X_2$ for track section B) in order to obtain in this way the longitudinal inclination of the 24-meter-long second frame part 8, inspite of the first frame part 6 being shorter. In the event of different length relationships of the frame parts, corresponding conversion calculations are required.

The longitudinal inclination value generated at the output of the shift register 41 for each meter travelled by the machine 1 is an average value of a multitude of measurements which are carried out at 2,5-centimeter intervals. In this, it is useful to disregard values which deviate extremely from the average value.

The longitudinal inclination value delivered by the shift register 41 to the adjusting device 30 at track location $X_3$ (corresponding to an addition of the two longitudinal inclination values measured at $X_1$ and $X_2$) causes a pivoting of the laser transmitter 25 in the longitudinal direction. Thus, the reference plane 29 is aligned parallel to the longitudinal inclination value obtained by adding the longitudinal inclination values for track sections A and B. This means that the second frame part 8 ought to lie parallel to the reference plane 29 if the existing or original position of the track had not been destroyed by operation of the working units 9. However, the reference plane 29, reproduced from the longitudinal inclination values stored and passed on in a timedelayed manner, makes it possible in the region of the working units 9 to refer to the destroyed existing position of the track as it was present before the operation of the working units 9. During said adjustment of the laser transmitter 25 for setting the reference plane 29 to correspond to the desired track position, it is necessary to take into account the momentary longitudinal inclination of the first frame part 6 connected to the laser transmitter 25, as the longitudinal inclination thereof will be different due to being dependent upon track section C.

In the schematic representation of the laser reference system 24 shown in FIG. 3, the two working units 9 are positioned exactly at the top of the rails of track 2 and thus are spaced, as are the rear undercarriage 3 and the laser transmitter 25, at a distance H from the reference plane 29. The laser receivers 26, with respect to their zero point, are positioned exactly in the reference plane 29 extending parallel to the track 2. Each cable potentiometer 37 shows the value zero with regard to the adjustment path (vertical measuring value S).

In the schematic representation of the laser reference system 24 according to FIG. 4, the two working units 9 are shown in the operating position, wherein the two vertical measuring values $S_1$ und $S_2$, detectable by the respective cable potentiometers 37, represent the measure of lowering of the track or the clearing depth R by the grading chain 13. Both vertical measuring values $S_1$ and $S_2$ can be set, as desired, as a pre-selected desired value. The dashed line 42 shows the theoretical point zero position of the laser receivers 26, since the two working units 9 as well as the rear undercarriage 3 are positioned below the desired position H or $H+S_1$ or $H+S_2$. Any deviation of the zero point of the laser receivers 26 from the reference plane 29 is equalized by the respective drive 31 causing a vertical adjustment. These adjustment paths V1 or V2, by corresponding actuation of the associated drives 12 or 10, automatically cause the grading chain 13 or clearing chain 11 to be hydraulically re-adjusted until the adjustment paths V1,V2 show the value zero.

The adjustment path V3 of the rear laser receiver 26 (V3=difference between the position of the laser receiver 26 before actuation of drive 31 and after reaching the desired position prescribed by the reference plane 29) corresponds to the actual amount of lowering of the track 2, which includes a possible settlement of the track caused by the load of the undercarriage 3. A possible deviation of the actual position of the track 2 from the desired position in the region of the rear undercarriage 3 may be equalized by entering a correction value in $S_1$ or $S_2$.

As an alternative to the described solution of fastening a longitudinal inclination meter 28 to the first frame part 6, it would also be possible to detect the longitudinal inclination of the first frame part 6 by means of a second laser reference system. To that end, it would merely be necessary to arrange a laser receiver in the region of the frontmost undercarriage 3, with the laser transmitter 25 being adjusted, for example, to a zero point of the said forward laser receiver in order to detect the longitudinal inclination of the first frame part 6. The longitudinal inclination thus detected may then be passed on in a time-delayed manner to the rearward laser receivers 26 (after addition of the two longitudinal inclination values detected for track sections A and B).

What is claimed is:

1. A mobile track working machine for rehabilitating a ballast bed supporting a track extending in a longitudinal direction, comprising (a) a machine frame extending in the longitudinal direction and supported on the track by undercarriages for mobility in an operating direction, the machine frame being composed of (1) a first frame part, leading in the operating direction, and (2) a second frame part linked thereto, (b) a longitudinal inclination meter mounted on the first frame part for detecting an inclination of the track in the longitudinal direction, (c) working units mounted on the second frame part, the working units being adjustable with respect to a vertical direction, (d) a laser reference system arranged on the machine frame for controlling the vertical position of the working units, the laser reference system being formed by (1) a laser transmitter on the first frame part for establishing a reference plane and (2) laser receivers on the second frame part for detecting said reference plane (e) an adjusting device associated with the laser transmitter for relative adjustment of the position of the reference plane, (f) an odometer mounted on the machine frame, and (g) a control device connected to the longitudinal inclination meter as well as to the odometer and the adjusting device, the control device being designed for conveying, in a time-delayed manner and in dependence upon the distance travelled by the machine as registered by the odometer, a longitudinal inclination value detected by the longitudinal inclination meter to the adjusting device for the purpose of adjusting the reference plane in accordance with the detected longitudinal inclination of the track.

2. The track working machine of claim 1, wherein the laser receivers are fastened to respective auxiliary frames, arranged on the second frame part, which are mounted for pivoting about an axis extending in the longitudinal direction by means of a drive and connected to an inclinometer.

3. The track working machine of claim 2, wherein the laser receivers are constructed for vertical adjustment relative to the auxiliary frame by means of a drive.

4. The track working machine of claim 2, wherein the auxiliary frame is mounted on a circular guide, extending transversely to the longitudinal direction, for transverse displacement relative to the second frame part by means of a drive.

5. The track working machine of claim 1, wherein one of said laser receivers is connected through a cable potentiometer to the working units formed for treating a ballast bed mounted on the machine frame and located underneath the laser receiver in the vertical direction.

6. The track working machine of claim 1, wherein one of said laser receivers, vertically adjustable by a drive, which drive is provided at the rear end of the second frame part with regard to the operating direction.

7. A method for restoring a position of a track extending in a longitudinal direction, which position has been destroyed in the course of rehabilitating a ballast bed supporting the track, using a track working machine having a machine frame composed of a first and second frame part, the method comprising the steps of (a) detecting an inclination of the track in the longitudinal direction with the aid of the first frame part, leading in an operating direction of the machine, (b) registering and storing a corresponding longitudinal inclination value, defined by the said first frame part, as a desired inclination value, (c) using said longitudinal inclination value in a time-delayed manner to correspondingly adjust the inclination of a reference plane, formed by a laser beam generated on the first frame part, as soon as the second frame part, in the course of working advance of the machine, reaches the local region of the detected longitudinal inclination of the track, and (d) using the reference plane for controlling the vertical position of working units located on the second frame part.

8. The method of claim 7, wherein laser receivers provided for registering the reference plane are permanently kept in a horizontal position independently of the position of the machine frame.

9. The method of claim 8, wherein the laser receivers are pivoted about an axis extending in the longitudinal direction.

10. The track working machine of claim 1, further comprising an articulation, wherein the first frame part is connected to the second frame part through the articulation.

* * * * *